United States Patent [19]

Sasser et al.

[11] Patent Number: 4,495,506

[45] Date of Patent: Jan. 22, 1985

[54] IMAGE SPATIAL FILTER

[75] Inventors: Bill H. Sasser, Tempe; Scott H. Walker, Scottsdale; Raymond G. Immell, Mesa, all of Ariz.

[73] Assignee: Motorola, Inc., Schaumburg, Ill.

[21] Appl. No.: 365,842

[22] Filed: Apr. 5, 1982

[51] Int. Cl.[3] ..... H01Q 15/02

[52] U.S. Cl. ..... 343/909; 343/753

[58] Field of Search ..... 343/909, 785, 771, 783, 343/911 R, 753

[56] References Cited

U.S. PATENT DOCUMENTS

| | | | |
|---|---|---|---|
| 4,021,812 | 5/1977 | Schell et al. | 343/909 |
| 4,125,841 | 11/1978 | Munk | 343/909 |
| 4,169,268 | 9/1979 | Schell et al. | 343/909 |
| 4,314,255 | 2/1982 | Kornbau | 343/909 |

OTHER PUBLICATIONS

Chen, Transactions on Microwave Theory and Techniques, vol. MTT-19, No. 5, May, 1971, pp. 475-481.

*Primary Examiner*—Eli Lieberman
*Assistant Examiner*—K. Ohralik
*Attorney, Agent, or Firm*—Jonathan P. Meyer

[57] ABSTRACT

An image spatial filter comprises back-to-back image cavities with means for coupling energy from one cavity to the other. Large angle of incidence energy is attenuated by each image cavity successively, thus providing a high degree of attenuation. Two quarter wavelength dielectric sheets with a ground plane between them and spaced from each by one-half wavelength form the image cavities. Slots in the ground plane provide coupling from one cavity to the other. Image spatial filters are not substantially more expensive than multi-layer dielectric spatial filters and are as easily fitted to existing antennas. But image spatial filters substantially reduce large angle passbands caused by the Brewster effect and by cavity resonance in dielectric spatial filters.

6 Claims, 4 Drawing Figures

IMAGE SPATIAL FILTER

FIELD OF THE INVENTION

The present invention relates, in general, to multilayer spatial filters for reducing sidelobe radiation in antennas. More particularly, the invention relates to an image spatial filter for reducing Brewster angle and resonance passbands existing in dielectric spatial filters.

BACKGROUND OF THE INVENTION

Many antennas are designed to interact primarily with electromagnetic energy propagating in a primary direction of propagation. The radiation pattern for such an antenna will generally exhibit a central lobe centered on the primary direction of propagation and some sidelobes at relatively large angles as measured from the primary direction of propagation. Depending upon the particular application for which the antenna is to be used, the presence of these sidelobes will, to a greater or lesser extent, degrade the performance of the antenna. Power levels in sidelobes may generally be reduced by redesign of the antenna. In many cases this will require a larger antenna which may be impossible to use for the particular application. In any case, the redesigned and more complex antenna will be more expensive.

Multi-layered dielectric spatial filters are known in the art for reducing sidelobes of existing antennas. In general, dielectric spatial filters comprise multiple layers of dielectric material having alternate high and low dielectric constants. The Brewster effect, which results in a decreased reflection coefficient at and near a certain angle called the Brewster angle, causes a serious degradation in the performance of multilayer dielectric spatial filters at and near the Brewster angle. The resulting passband in the filter response allows large angle sidelobes to pass which should be rejected. Other large angle passbands in the filter response curve are caused by cavity resonances, which occur at angles at which the distance between adjacent layers of the filter is an integral multiple of one-half wavelength. These two effects combine to seriously impair the ability of multilayer dielectric spatial filters to reject large angle sidelobes.

SUMMARY OF THE INVENTION

Accordingly, it is an object of the present invention to provide an improved spatial filter.

It is a further object of the invention to provide an image spatial filter having an improved reflection coefficient at large angles of incidence.

A particular embodiment of the present invention comprises a pair of back-to-back image cavities disposed in front of an antenna, to reduce the the sidelobes thereof. A first image cavity comprises a first dielectric sheet and a first side of a ground plane. The dielectric sheet is preferably one-quarter of an effective wavelength thick and spaced one-half wavelength from the ground plane. The first image cavity accepts electromagnetic energy from the antenna and attenuates sidelobes through multiple internal reflections. A second image cavity comprises the other side of the ground plane and a second dielectric sheet. Slots in the ground plane couple energy from one cavity to the other. Energy from the antenna is coupled from the first image cavity to the second image cavity, which radiates it into space with further attenuation of sidelobes. The slots may be of various dimensions and spacings so as to provide efficient energy coupling between the image cavities. It is not necessary that the slots be of resonant dimensions and may, in fact, be smaller than cut-off dimensions in some circumstances.

The image spatial filter described retains the cost advantages and ease of retro-fitting of prior art dielectric spatial filters while significantly improving large angle of incidence performance.

These and other objects and advantages of the present invention will be apparent to one skilled in the art from the detailed description below taken together with the drawings.

DETAILED DESCRIPTION OF THE INVENTION

The principles of operation of image element antennas are well known in the art, so they will not be discussed in detail here. Briefly, a ground plane with antenna elements therein is spaced from a dielectric sheet and forms an image cavity therewith. Multiple internal reflections in the cavity produce a large number of phase shifted images of the antenna elements, thus forming a radiation pattern with a high gain central lobe and attenuated sidelobes.

Figure 1:
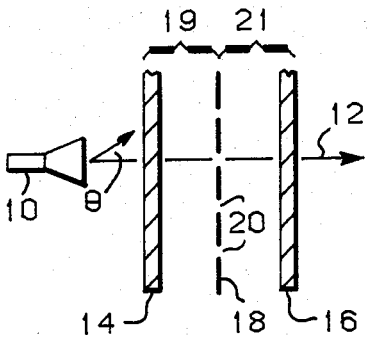
FIG. 1 is a simplified cross-sectional view of a reduced side lobe antenna utilizing an image spatial filter according to the present invention.

Referring now to FIG. 1, a reduced sidelobe antenna is shown. An antenna 10, the sidelobes of which are to be reduced, defines a primary direction of propagation 12. While antenna 10 is shown here as a horn antenna it is not intended to so limit the scope of the present invention. An angle of incidence ($\theta$) is defined with respect to direction 12 as shown in FIG. 1. A first dielectric sheet 14 is located in front of antenna 10 intersecting primary direction of propagation 12 and substantially perpendicular thereto. First dielectric sheet 14 is preferably one-quarter of an effective wavelength thick. As will be apparent to those skilled in the art, many different materials and dielectric constants are suitable for dielectric sheet 14. A dielectric material with a relative dielectric constant of approximately 30 has been used with success. A ground plane 18, which may be any convenient thin metal sheet, is located in front of dielectric sheet 14 and parallel thereto. The spacing between ground plane 18 and dielectric sheet 14 is preferably one-half wavelength but it may also be one wavelength or greater. First dielectric sheet 14 and ground plane 18 form a first image cavity 19. A second dielectric sheet 16, which is substantially similar to first dielectric sheet 14, is located in front of ground plane 18 and parallel thereto. Second dielectric sheet 16 and ground plane 18 form a second image cavity 21. A plurality of slots 20 defined by ground plane 18 couple electromagnetic energy from one image cavity to the other. Slots 20 are adapted to couple energy efficiently from one image cavity to the other. Details of sizing and spacing of slots 20 are discussed below.

The operation of the reduced sidelobe antenna of FIG. 1 is described below with reference to electromagnetic energy emitted by antenna 10. As is well known in the art, the operation is the same for energy received by antenna 10. Energy leaving antenna 10 enters first image cavity 19 through first dielectic sheet 14. When the energy reaches ground plane 18 a certain percentage will be coupled through slots 20 to second image cavity 21. The percentage of energy reflected will be determined by the percentage of the area of ground plane 18 covered by slots 20. The energy reflected from ground plane 18 will impinge upon the back side of first dielectric 14 and be partially reflected thereby. When this re-reflected energy reaches ground plane 18 for the second time it will be out of phase with energy reaching ground plane 18 directly by an amount which is depending upon the angle of incidence ($\theta$). In this well known fashion, the multiple internal reflections in image cavity 19 provide attenuation of energy with a large angle of incidence ($\theta$). The number and spacing of slots 20 is chosen to provide sufficient area of ground plane 18 for this process to take place. However, there must also be sufficient slots 20 to couple energy from first image cavity 19 to second image cavity 21 without too great an impedance discontinuity. It has been found that a spacing of approximately one and one-half wavelength is satisfactory. Once the energy has been coupled into second image cavity 21 the same mechanism provides further attenuation for energy propagating at large angles to the primary direction of propagation 12.

Two effects are responsible for the large angle passbands in prior art dielectric spatial filters. The first is the Brewster effect. The Brewster effect is characterized by a sharp decrease in the reflectivity (for energy polarized parallel to the plane of incidence) of a dielectric sheet at and near an angle called the Brewster angle. For dielectric spatial filters, and to a lesser extent for image antennas, this results in a breakdown of the mechanism which produces attenuation of large angle energy. Image cavities are generally less susceptible to Brewster angle passbands because the total reflectivity of the ground plane as opposed to a dielectric sheet provides a higher gain at low angles as compared to high angles, therefore reducing the importance of the Brewster effect.

The second effect, which is referred to herein as cavity resonance, occurs at angles of incidence for which the distance traveled between adjacent layers of the filter is an integral multiple of one-half wavelength. At these angles the phase difference caused by an internal reflection is a multiple of one wavelength, resulting in constructive rather than destructive interference. For instance, at a spacing of one-half wavelength, the distance traveled between layers at an angle of 60° is one wavelength, thus creating a passband in the filter response at and near 60°. There is still some attenuation at these large angle passbands relative to the primary direction of propagation because much of the internally reflected energy will reach the edges of the filter and be lost prior to being transmitted through the dielectric sheet. The use of back-to-back image cavities as taught by the present invention multiplies this attenuation and significantly reduces the problem of resonance passbands.

Figure 2:
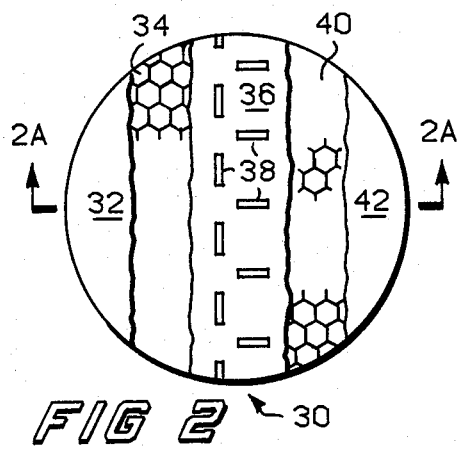
FIG. 2 is a front view of a partially cut away image spatial filter according to the present invention.
Figure 2A:
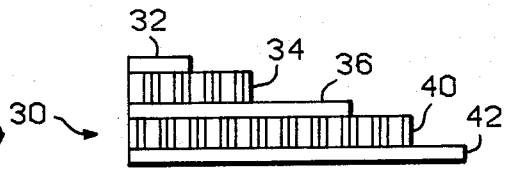
FIG. 2A is a side view of the image spatial filter of FIG. 2.

Referring now to FIGS. 2 and 2A, a partially cutaway image spatial filter 30 according to the present invention is shown in front and side views, respectively. A first dielectric sheet 32 and ground plane 36 form a first image cavity. The structural relation between first dielectric sheet 32 and ground plane 36 is maintained by honeycomb 34. Honeycomb 34 is one example of the many means available for maintaining the spacing and parallel relationship between dielectric sheet 32 and ground plane 36 while not substantially interfering with the operation of filter 30. Commercially available products such as Hexcel HRH-10 honeycomb are well known in the art for this purpose. A newly available Hexcel Kevlar® honeycomb is preferred for its extremely low thermal coefficient of expansion and low moisture absorption. Several techniques are available for machining the honeycomb to the thickness tolerances required. It is also well known that such honeycombs have anisotropic dielectric constants, therefore requiring careful orientation if more than one polarization of energy is to be used. In the same manner of the first image cavity a second image cavity is formed by ground plane 36 and a second dielectric sheet 42 which are maintained in spatial relationship by honeycomb 40. Slots 38 defined by ground plane 36, which couple energy from one image cavity to the other, are shown here in two different orientations. This arrangement would be appropriate if the antenna with which image spatial filter 30 is to be used is dual polarized. It is not intended to limit the scope of the present invention to any particular type or arrangement of slots 38. Furthermore, other means for coupling energy from one image cavity to the other are available. For instance, if very high frequencies are utilized, such that ground plane 36 is thick as compared to one wavelength, then waveguide portions which are appropriately dimensioned for propagation of the frequencies of interest must be utilized to couple the energy. It is also possible to utilize a very thick ground plane 36 and waveguide coupling means to allow the use of active elements in the waveguides to effect the electromagnetic energy as it is coupled from one image cavity to the other. Within the primary purposes of providing reflectivity and an impedance match between the image cavities, many variations of ground planes and coupling means are possible.

Figure 3:
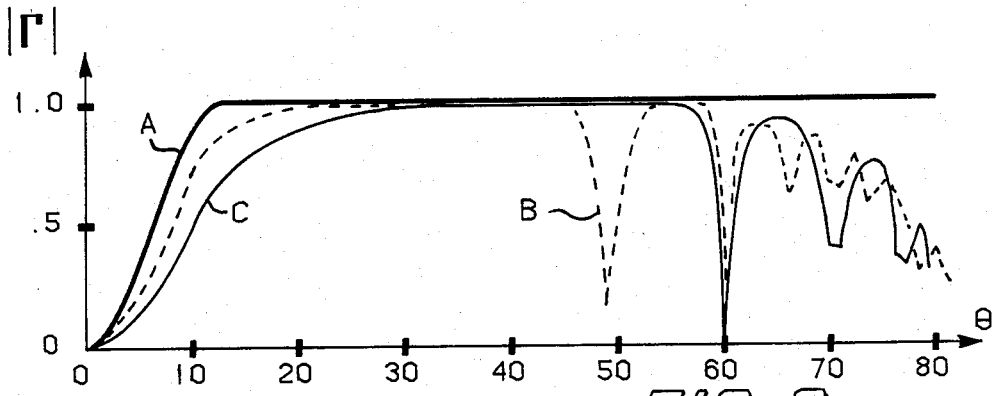
FIG. 3 is a graph comparing the reflection coefficients as a function of angle of incidence for an image spatial filter and for two dielectric spatial filters.

Referring now to FIG. 3, a graph of the normalized reflection coefficient versus angle of incidence is shown. The curves represent the reflection coefficient calculated for the E plane utilizing a point source. Curve A represents an image spatial filter having sheets of dielectric constant equal to thirty and a one-half wavelength spacing. Curve B represents that reflection coefficient of a dielectric spatial filter comprising two sheets of the same dielectric material separated by one wavelength. Curve C is the same filter as curve B utilizing a spacing of one-half wavelength. Both curves B and C exhibit a sharp passband caused by cavity resonance at approximately 60°. Curve B exhibits a further resonance passband at approximately 48°. Furthermore, both curves B and C demonstrate the severe decline in reflection coefficient for angles beyond approximately 65° which is caused by the Brewster effect. Curve A, on the other hand, has no perceptible large angle passbands when plotted on this scale. This is not to say that the reflection coefficient represented by curve A is identically equal to one for all large angles, merely that deviations from a reflection coefficient of 1 are not visible on this scale. It is also noted that the image spatial filter represented by curve A has a somewhat narrower central passband.

While the invention has been particularly shown and described with reference to a preferred embodiment thereof, it will be understood by those skilled in the art that various other modifications and changes may be made to the present invention from the principles of the invention described without departing from the spirit and scope thereof.

We claim:

1. An image spatial filter comprising:

a first dielectric sheet;

a second dielectric sheet substantially parallel to and spaced from said first dielectric sheet;

a ground plane between, substantially parallel to and separated from said first and second dielectric sheets;

coupling means defined by said ground plane for coupling energy from one side of said ground plane to another side thereof; and spacing means for maintaining said spaced apart and substantially parallel relationship between said first and second dielectric sheets and said ground plane.

2. An image spatial filter according to claim 1 wherein said coupling means comprises:

a plurality of slots defined by said ground plane, said slots being adapted to couple energy from one side of said ground plane to another side thereof.

3. An image spatial filter according to claim 1 wherein said ground plane is spaced from said first and second dielectric sheets by approximately an integral multiple of one-half wavelength.

4. A reduced sidelobe antenna comprising:

antenna means for receiving and transmitting electromagnetic energy, said antenna means defining a primary direction of propagation;

a first dielectric sheet in front of said antenna means substantially perpendicular to said primary direction of propagation;

a ground plane in front of said dielectric sheet and spaced therefrom;

a second dielectric sheet in front of said ground plane and spaced therefrom;

spacing means for maintaining said spaced apart relationship between said ground plane and said first and second dielectric sheets; and coupling means defined by said ground plane for coupling electromagnetic energy from one side of said ground plane to another side thereof.

5. A reduced sidelobe antenna according to claim 4 wherein said coupling means comprises:

a plurality of slots defined by said ground plane, said slots being adapted to couple electromagnetic energy from one side of said ground plane to another side thereof.

6. A reduced sidelob antenna according to claim 4 wherein said ground plane is spaced from said first and second dielectric sheets by approximately an integral multiple of one-half wavelength.

* * * * *